US007508403B2

(12) United States Patent
Mikami et al.

(10) Patent No.: US 7,508,403 B2
(45) Date of Patent: Mar. 24, 2009

(54) IMAGE FORMING APPARATUS

(75) Inventors: Masato Mikami, Saitama (JP); Kunihiro Maie, Saitama (JP); Kouji Tsutsumi, Saitama (JP); Shingo Yano, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 242 days.

(21) Appl. No.: 11/333,332

(22) Filed: Jan. 18, 2006

(65) Prior Publication Data

US 2007/0064086 A1 Mar. 22, 2007

(30) Foreign Application Priority Data

Sep. 16, 2005 (JP) ..... P2005-271108

(51) Int. Cl.
*B41J 2/455* (2006.01)
*B41J 2/385* (2006.01)
*B41J 2/45* (2006.01)

(52) U.S. Cl. ..... 347/130; 347/233; 347/238

(58) Field of Classification Search ..... 347/233, 347/130, 238

See application file for complete search history.

(56) References Cited

U.S. PATENT DOCUMENTS

| | | | | |
|---|---|---|---|---|
| 5,621,453 | A * | 4/1997 | Fujita et al. | 347/240 |
| 5,828,396 | A * | 10/1998 | Seto et al. | 347/111 |
| 5,883,725 | A * | 3/1999 | Sawano | 358/3.07 |
| 6,655,861 | B2 * | 12/2003 | Yamakawa | 400/76 |
| 2004/0160508 | A1 * | 8/2004 | Ono | 347/237 |
| 2006/0044386 | A1 * | 3/2006 | Ishikawa | 347/238 |

FOREIGN PATENT DOCUMENTS

| | | | |
|---|---|---|---|
| JP | 09-174932 | A | 7/1997 |
| JP | 2004-025678 | A | 1/2004 |

* cited by examiner

*Primary Examiner*—Stephen D Meier
*Assistant Examiner*—Sarah Al-Hashimi
(74) *Attorney, Agent, or Firm*—Sughrue Mion, PLLC

(57) ABSTRACT

An image forming apparatus utilizing a light-emitting diode (LED). The image forming apparatus includes: an LED head including an LED array that has a plurality of dots, in which a resolution a (dpi) of the LED array and a resolution b (dpi) in a main scanning direction at an image data exposure satisfy a relation: a>b (a being an integral multiple of b); and a lighting control unit that performs a lighting control for the LED head such that main dots used for an exposure are turned on in every {(a/b)−1} dots.

9 Claims, 10 Drawing Sheets

IMAGE FORMING APPARATUS

BACKGROUND OF THE INVENTION

1. Field of the Invention

The present invention relates to an improvement on an image forming apparatus utilizing a light-emitting diode (LED).

2. Description of the Related Art

Various image forming apparatuses utilizing LEDs have already been in practical use, but an LED head employed in such apparatuses has a limited depth of focus in a condensing lens, and, with a defocus of ±50 μm, may show a deterioration in the focusing ability, thus resulting in a dispersion of light. In such case, a condensed light spot formed on a surface of a photosensitive drum by the light condensed with the lens becomes larger in size, thereby possibly causing a change in the density of a halftone image.

FIGS. 10A and 10B show toner images formed on the surface of the photosensitive drum, by irradiating the surface of the photosensitive drum with the condensed light spot and then supplying a toner according to a predetermined procedure. FIGS. 10A and 10B show a halftone image formed by condensed light spots in a checkerboard pattern, taking 2×2 pixels as a spot, in which a broken-lined square represents a pixel.

FIG. 10A shows a state where the condensed light spot is in focus, in which the toner images have a space therebetween as anticipated, thereby providing a halftone image of an appropriate density. On the other hand, FIG. 10B shows a state where the condensed light spot is defocused and becomes somewhat larger. Thus, the toner images become connected between mutually near portions thereof, whereby the space shown in FIG. 10A becomes smaller. As a result, the halftone image has a density higher than a desired density.

In order to solve the drawback associated with the defocus of the condensed light spot, the JP-A-2004-25678 discloses a technology of employing a motor for displacing the LED head in a focusing direction and displacing the LED head according to a set value entered by an operator thereby regulating the focus point to an optimum position.

Also JP-A-9-174932 discloses a technology of placing a light controlling film between a light-emitting part and a lens in the LED head to suppress a light spreading, thereby relaxing the defocus.

However such prior technologies involve drawbacks of complicating the structure of the LED head, thereby elevating the production cost.

SUMMARY OF THE INVENTION

The present invention has been made in consideration of such drawbacks in the prior technologies, and provides an image forming apparatus employing an LED head, which realizes little defocus with a simple and inexpensive structure.

The invention may provide an image forming apparatus utilizing a light-emitting diode (LED), including: an LED head including an LED array that has a plurality of dots, in which a resolution a (dpi) of the LED array and a resolution b (dpi) in a main scanning direction at an image data exposure satisfy a relation: a>b (a being an integral multiple of b); and a lighting control unit that performs a lighting control for the LED head such that main dots used for an exposure are turned on in every {(a/b)−1} dots.

BRIEF DESCRIPTION OF THE DRAWINGS

Embodiment may be described in detail with reference to the accompanying drawings.

DETAILED DESCRIPTION OF THE INVENTION

In the following, best modes, hereinafter called embodiments, for executing the present invention will be explained with reference to the accompanying drawings.

EMBODIMENT 1

Figure 1:
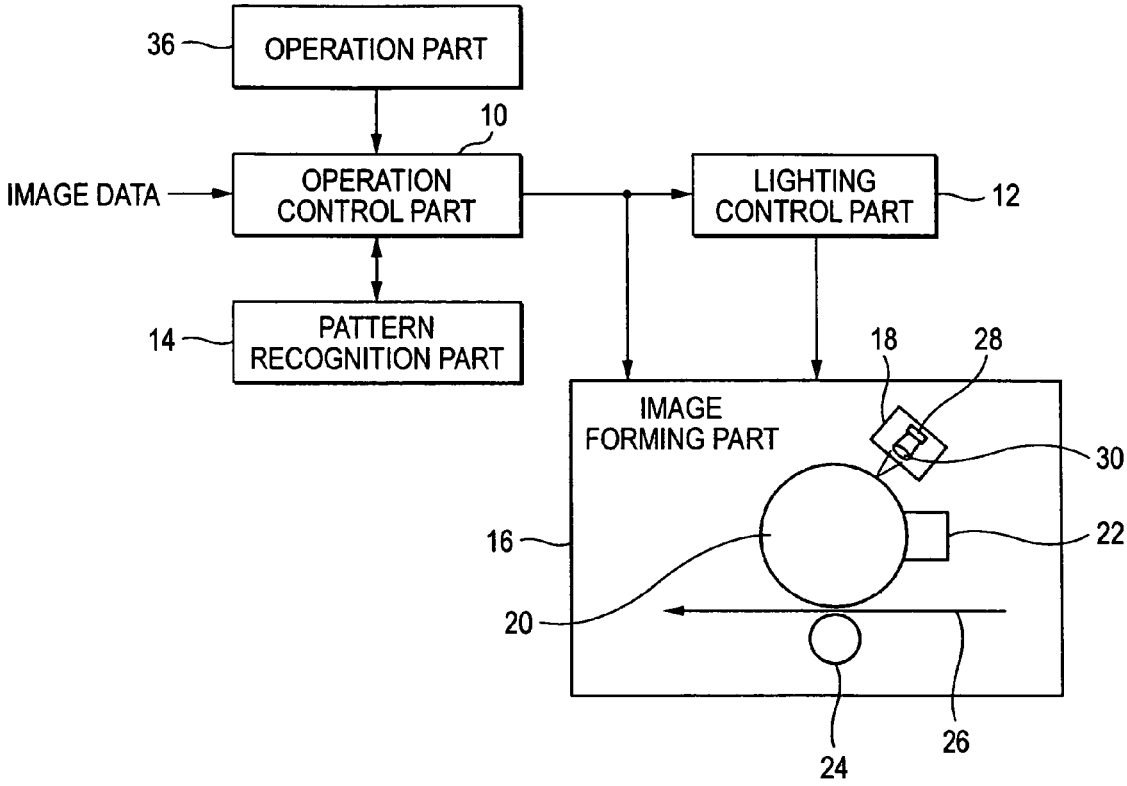
FIG. 1 is a block diagram showing a structure of an embodiment of an image forming apparatus.

FIG. 1 is a block diagram showing a configuration of an embodiment 1 of the image forming apparatus of the present invention. Referring to FIG. 1, the image forming apparatus includes an operation control part 10, a lighting control part 12, a pattern recognition part 14, an image forming part 16, an LED head 18 and an operation part 36.

The operation control part 10 acquires image data from a scanner or another computer, gives an instruction to the lighting control part 12 and controls an operation of the image forming apparatus for forming an image based on the acquired image data.

The lighting control part 12 controls turning on/off of each light-emitting diode in an LED array formed in the LED head.

The pattern recognition part 14 executes a process of extracting a matrix of c pixels in the main scanning direction by d pixels in the sub scanning direction around a target pixel in the image data, and recognizing a pattern of light-emitting diodes turned on in the matrix.

The image forming part 16 includes, in addition to the LED head 18, a photosensitive drum 20, a developing unit 22, a transfer roller 24 and the like, and forms an image of the image data on a specified sheet 26.

The LED head 18 is a constituent of the image forming part 16, and emits a light for exposing the photosensitive drum 20 from a linear LED array of light-emitting diodes (hereinafter called dots) 28. The light is condensed by a lens 30 to form a condensed light spot on the surface of the photosensitive drum 20.

The operation par 36 is formed by a keyboard or a touch panel and is used by a user for entering instructions necessary for control operations executed by the operation control part 10.

Figure 2:
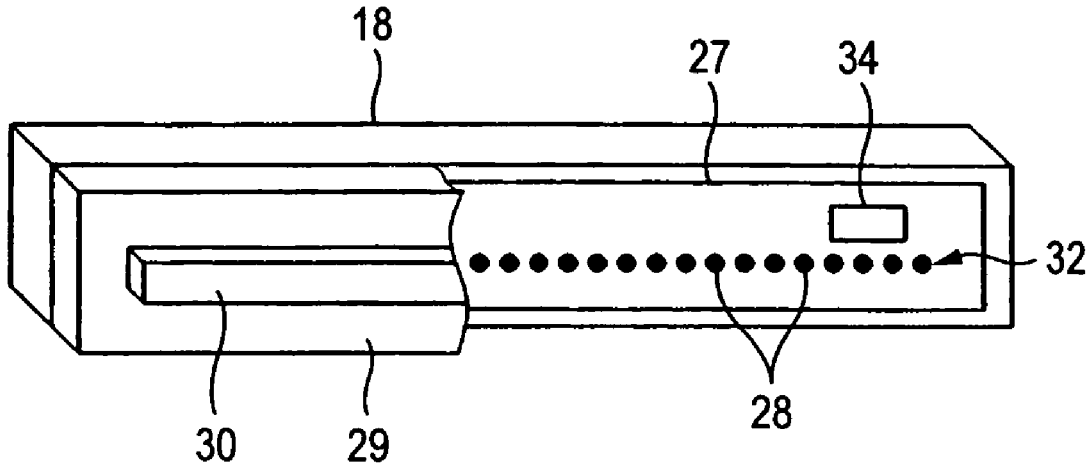
FIG. 2 is a perspective view showing a structure of an LED head.

FIG. 2 is a perspective view showing an example of the LED head 18. Referring to FIG. 2, the LED head 18 is provided with a substrate 27, on which a linear LED array 32 of light-emitting diodes 28 is formed. The LED head 18 also has a memory 34 storing correction data for correcting light emission amounts of the dots 28. The correction data are used, in consideration of unevenness in the light amounts of the dots 28, in the dot areas, in the dot pitch and in the condensing lens 30 for condensing the lights emitted from the dots 28, for regulating for example driving currents for the dots 28 so as to form uniform condensed light spots on the photosensitive drum 20. The LED array 32 is covered by a cover member 29, in front of which a condensing lens 30 is provided. In FIG. 2, the cover 29 and the condensing lens 30 are partially cut off to expose the LED array 32.

The structures shown in FIGS. 1 and 2 are employed not only in the embodiment 2 but also commonly in embodiments 2 to 8.

Figure 3:
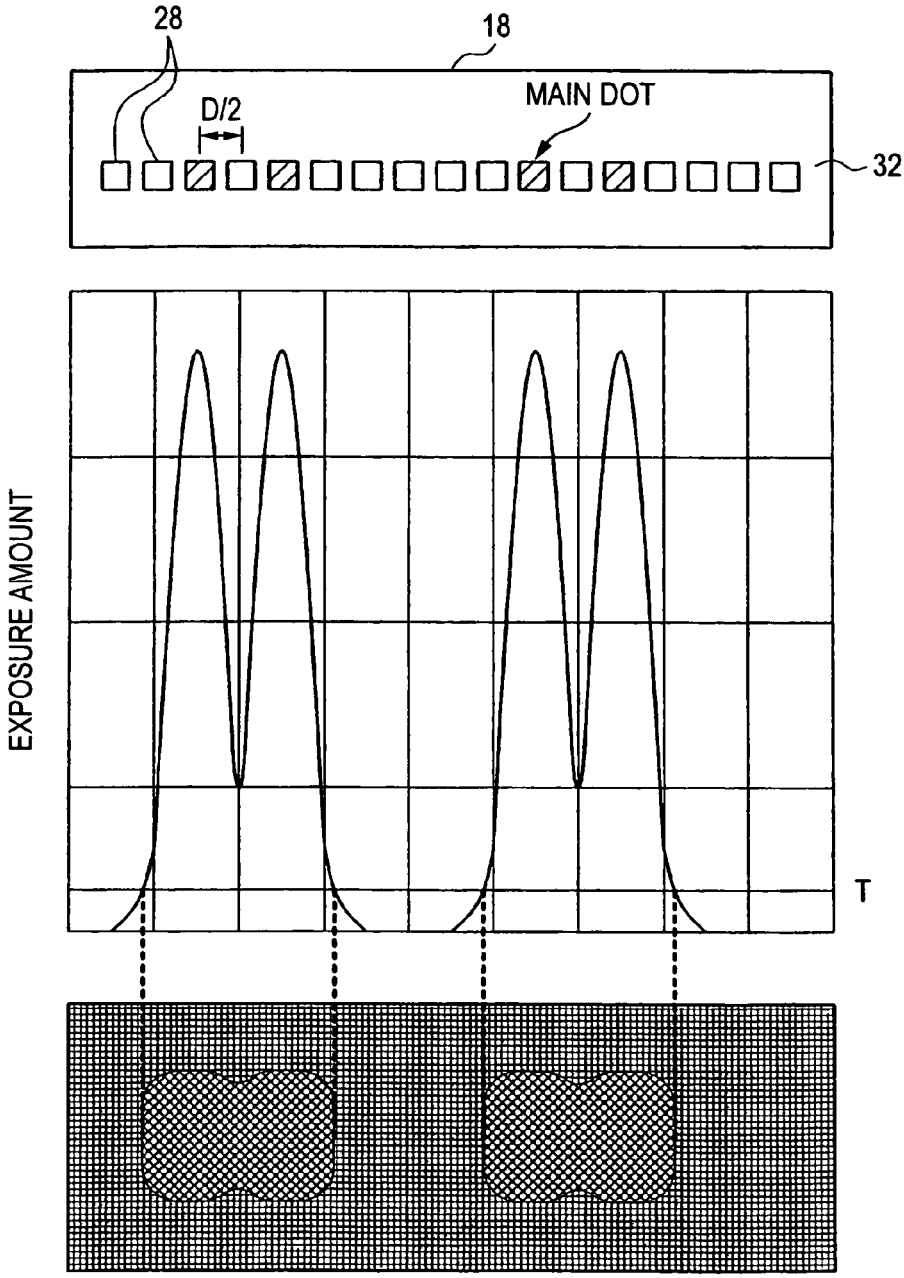
FIG. 3 is a view showing an effect of a change in a resolution of an LED array in the LED head.
Figure 4:
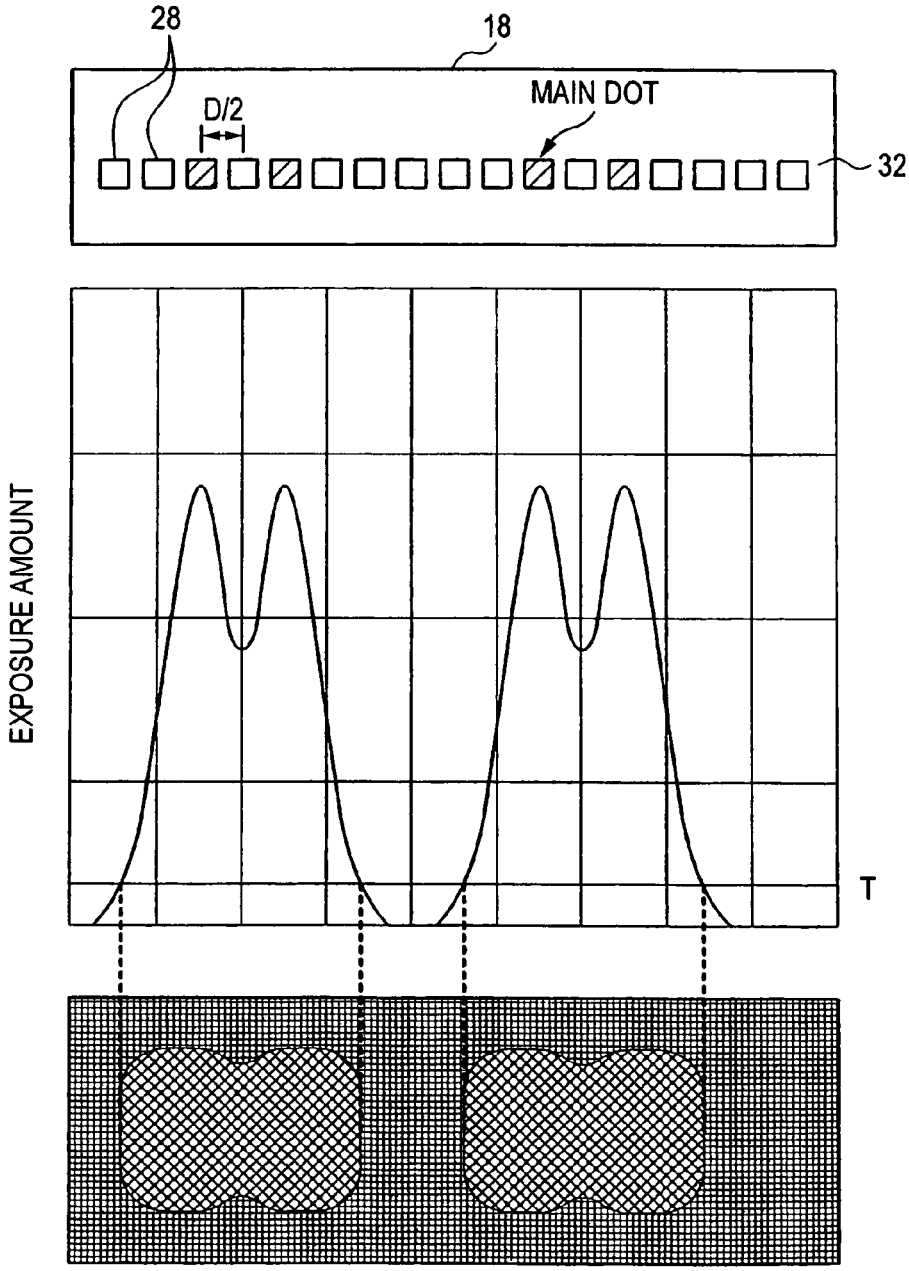
FIG. 4 is a view showing an effect of a change in a resolution of an LED array in the LED head.
Figure 5:
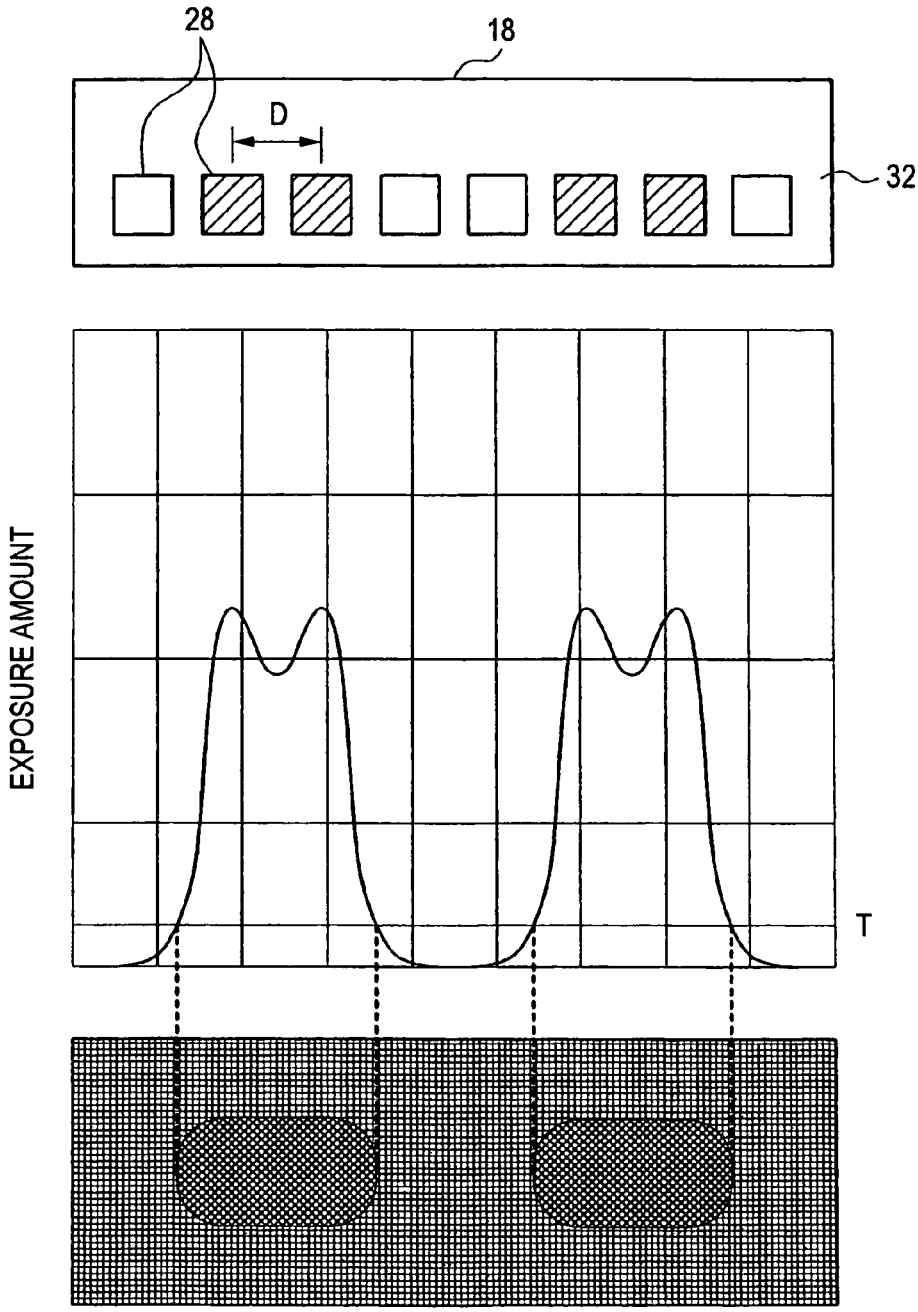
FIG. 5 is a view showing an effect of a change in a resolution of an LED array in the LED head.
Figure 6:
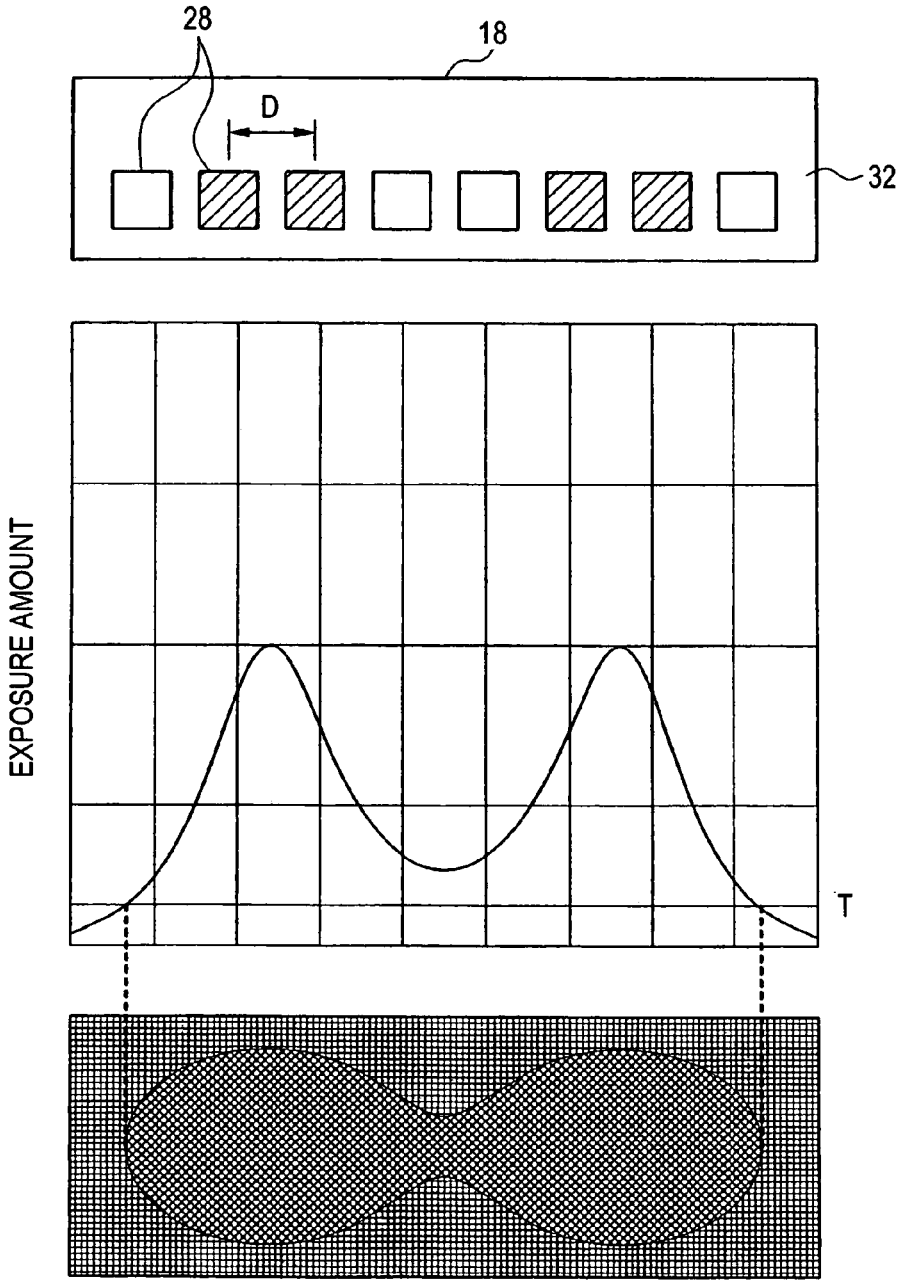
FIG. 6 is a view showing an effect of a change in a resolution of an LED array in the LED head.

FIGS. 3, 4, 5 and 6 illustrate effects in case of varying a size of the dot 28 and a resolution of the LED array 32 constructed in the LED head 18. FIGS. 3 and 4 show a case of a high resolution with a pitch D/2 between the dots 28, while FIGS. 5 and 6 show a case of a low resolution with a pitch D between the dots 28.

Between a resolution a (dpi) of the LED array 32 shown in an upper part of FIGS. 3 and 4 and a resolution b (dpi) in the main scanning direction at the exposure of the photosensitive drum 20 with the image data, there stands a relationship:

$$a>b$$

wherein a is an integral multiple of b. This corresponds, for example, to a case of mounting an LED head 18 of 1200 dpi on an image forming apparatus of a specified resolution of 600 dpi.

When the above-mentioned relationship stands, the lighting control part 12 executes a lighting control on the LED head 18 under a skipping of the dots 28, in such a manner that dots at an interval of every $\{(a/b)-1\}$ dots are used for exposing the photosensitive drum 20. A dot 28 thus used for exposing the photosensitive drum 20 is called a main dot, and a dot adjacent thereto is called an auxiliary dot. The auxiliary dot may be turned on together with the main dot to assist the exposure on the photosensitive drum 20.

For example, in case of mounting an LED head 18 of 1200 dpi on an image forming apparatus of a specified resolution of 600 dpi, the lighting control part 12 turns on odd-numbered dots 28, thereby executing the lighting control as an LED head of 600 dpi. In this case, the odd-numbered turned-on dots 28 correspond to the main dots. In FIGS. 3 and 4, the turned-on dot is indicated by a hatching.

In the present embodiment, as shown in the upper part of FIGS. 3 and 4, two main dots are turned on for a pixel. Also an exposure amount of the photosensitive drum 20 in this case is shown in a graph in the middle part. Also the lower part shows a toner image formed on the exposed surface of the photosensitive drum 20.

Figure 10A:
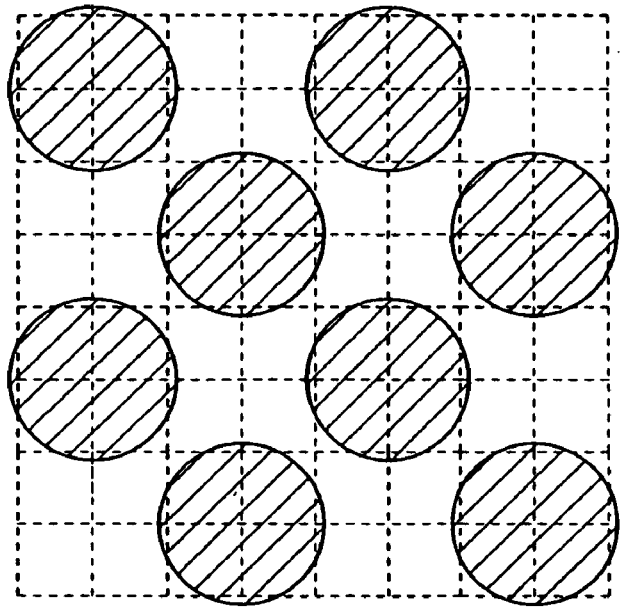
FIGS. 10A and 10B are views showing a toner image formed on a surface of a photosensitive drum in a prior technology.
Figure 10B:
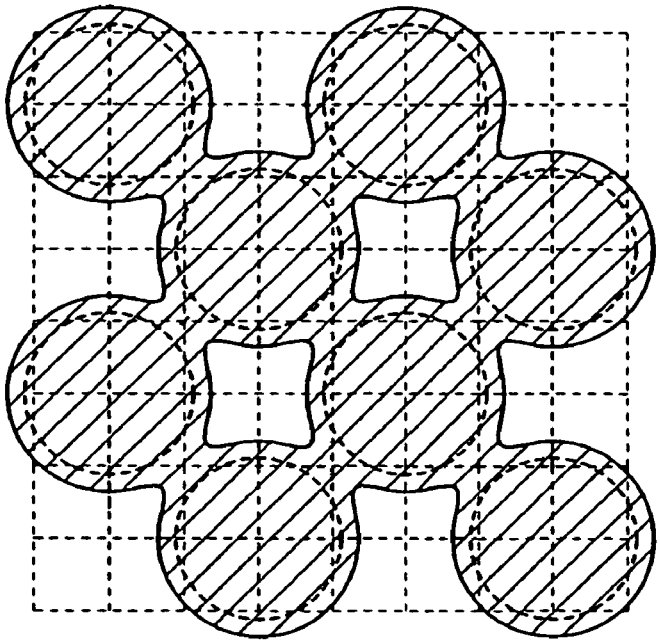

The graph in FIG. 3 shows an exposure distribution in case condensed light spots, formed by condensing the light from the dot 28 onto the surface of the photosensitive drum 20, are in focus, while the graph in FIG. 4 shows an exposure distribution in case the condensed light spots are slightly out of focus. Also a threshold value for developing the exposure distribution on the surface of the photosensitive drum 20 with the developing unit 22, namely an exposure amount required for depositing the toner onto the photosensitive drum 20, is indicated by T. As will be apparent from the graphs shown in FIGS. 3 and 4, the exposure amount between the two condensed light spots is lower than the threshold value T, both when the condensed light spots are in focus and are slightly out of focus. Therefore, the toner images are in a mutually separate state in both cases shown in the lower parts of FIGS. 3 and 4. As a result, the toner images can be prevented from being connected in mutually near portions as in FIG. 10B. Though the toner images shown in the lower part of FIG. 4 are somewhat larger than those in the lower part of FIG. 3, the difference of this level does not significantly affect the image density. Consequently, a halftone image is less influenced in the density by an error in the focus state of the condensed light spot, and the image density can be stabilized.

On the other hand, in FIGS. 5 and 6, two adjacent dots 28 are turned on for a pixel, among the dots 28 within the LED array 32. Each dot 28 is formed larger than that in FIGS. 3 and 4. In this case, in an exposure distribution with the condensed light spots in focus, shown in the middle part of FIG. 5, the exposure amount between the two condensed light spots is smaller than the threshold value T, but, in an exposure distribution with the condensed light spots slightly out of focus, shown in the middle part of FIG. 6, the exposure amount between the two condensed light spots becomes higher than the threshold value T. As a result, as shown in the lower part of FIG. 6, the adjacent toner images may become mutually connected in an out-of-focus state. Consequently, a halftone image is more easily affected in the density by an error in the focus state of the condensed light spot, and shows a density higher than the desire density.

Thus the density stabilization in the halftone image can be attained by reducing the size of each dot 28, selecting the resolution of the LED array 32 as an integral multiple of the resolution in the main scanning direction at the exposure on the photosensitive drum 20, and executing the lighting control under skipping of the dots 28.

Figure 7:
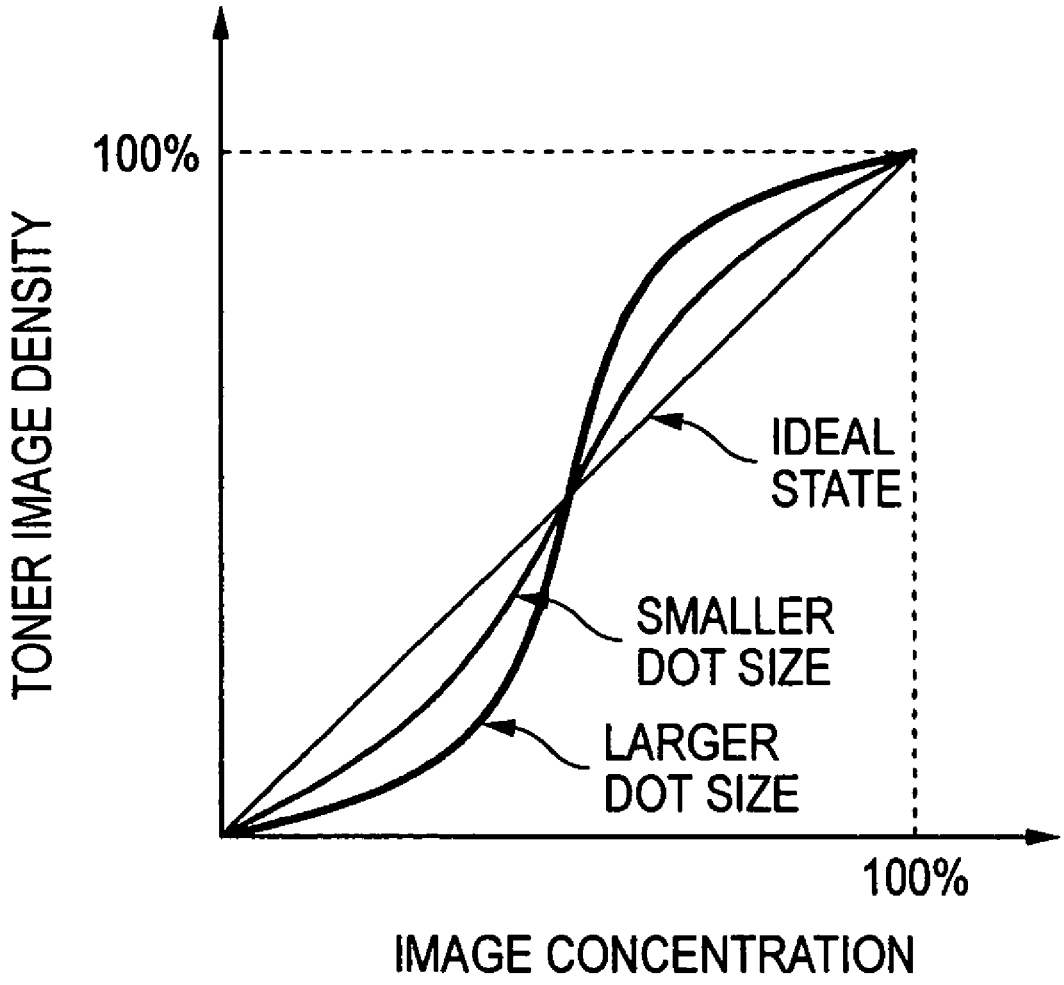
FIG. 7 is a chart showing a relationship between an image concentration and a toner image density formed on a sheet, in a halftone image.

FIG. 7 shows a relationship between an image concentration (concentration of pixels on which the toner is to be deposited) and a toner image density formed on the sheet, when a halftone image is formed with the above-explained toner images. In FIG. 7, the image concentration and the toner image density are proportional (in linear relationship) in an ideal situation, but, with a larger size of the dots 28, the toner image density becomes higher at a higher image concentration and tends to results in a solid image, which means an image with a highest toner image density. Also in case the exposure amount is reduced in order to relax such phenomenon, the toner image density inversely becomes excessively low in an area of a low image concentration, tending to provide a thinned image. Therefore the image concentration-toner image density relationship is represented by an S-shaped curve with a large curvature.

On the other hand, a smaller size of the dots 28 as shown in the upper parts of FIGS. 3 and 4, can suppress the mutual connection of the toner images, thereby preventing the halftone image from shifting to a higher density in a higher image concentration and also preventing a thinned image at a lower image concentration. Therefore the image concentration-toner image density relationship assumes an almost linear S-shaped curve.

Thus the present embodiment can realize an LED head with little defocus by a simple and inexpensive structure of reducing the size of the dots 28 and turning on the dots 28 in a skipped manner, thereby providing an advantage of facilitating the density control of the halftone image.

EMBODIMENT 2

The present embodiment adopts the above-described relationship a=2b. Also the operation part 36 of the image forming apparatus, shown in FIG. 1, is equipped with a selection button for the type of the original, for enabling a selection of a type of the image data, such as "photograph" and "character/line image". In case the user selects "photograph" on the operation part 36, the operation control part 10 sends such instructed selection to the lighting control part 12, which controls the LED head 18 so as to expose the photosensitive drum 20 only by the odd-numbered dots 28 within the LED array 32 shown in FIG. 2. Thus an exposure capable of stabilizing the halftone density is made possible according to the principle explained in the embodiment 1.

On the other hand, when the user selects "character/line image", in addition to the odd-numbered dots 28 in the LED array 32, the adjacent even-numbered dots 28 are also turned on. More specifically, the lighting control part 12 controls the LED head 18 in such a manner that an even-number dot 28 and an odd-numbered dot 28 function as a pair. Therefore, for example, a first dot 28 and a second dot 28 execute a turn-on/off operation simultaneously, and a third dot 28 and a fourth dot 28 execute a turn-on/off operation simultaneously. As a result, an image output of a high density can be realized with little image thinning or unevenness in density, for a drawing in which a fine line to be firmly reproduced, a document or an original containing a solid image. In such case, a mere doubled number of the turned-on dots 28 may result in an excessive exposure, leading to an excessively high image density or an excessively thick line. In such case, the odd-numbered dots 28 are strongly turned on as main dots, and the even-numbered dots 28 are weakly turned on as auxiliary dots. Stated differently, they are so controlled that an average light amount of the main dots is different from an average light amount of the auxiliary dots. In this manner an appropriate density can be obtained in the "character/line image" mode.

Also in case of employing the image forming apparatus of the present embodiment as a printer, a similar lighting control is possible by providing a computer display image for instructing a print with a button for selecting the type of the original.

EMBODIMENT 3

Also the present embodiment adopts the above-described relationship a=2b. Also as in the embodiment 2, the operation part 36 of the image forming apparatus, shown in FIG. 1, is equipped with a selection button for the type of the original, for enabling a selection of a type of the image data, such as "photograph" and "character/line image". In addition, the present embodiment utilizes the odd-numbered dots 28 only for exposing the photosensitive drum 20.

In case the user selects "photograph" on the operation part 36, the operation control part 10 sends such instructed selection to the lighting control part 12. In this case, the lighting control part 12 gives a priority to the stability of the halftone density, and controls the LED head 18 in such a manner that the dots 28 emit light providing a relatively low exposure amount, in order to prevent the toner images from being mutually connected in the space therebetween thereby resulting in a high density of the halftone image.

On the other hand, when the user selects "character/line image", the LED head 18 is controlled in such a manner that the dots 28 emits light providing a relatively high exposure amount, in order to avoid a thinning in a fine line and to avoid a density unevenness in the solid image.

Levels of such exposures are determined in advance on graphs as shown in the middle parts of FIGS. 3 and 4, and the light-emitting operation of the dots 28 is controlled according to such graphs.

The present embodiment is featured in that the lighting control part 12 controls the exposure amount of the dots 28 according to the type of the image data.

Also in case of employing the image forming apparatus of the present embodiment as a printer, a similar lighting control is possible by providing a computer display image for instructing a print with a button for selecting the type of the original.

EMBODIMENT 4

Figure 8A:
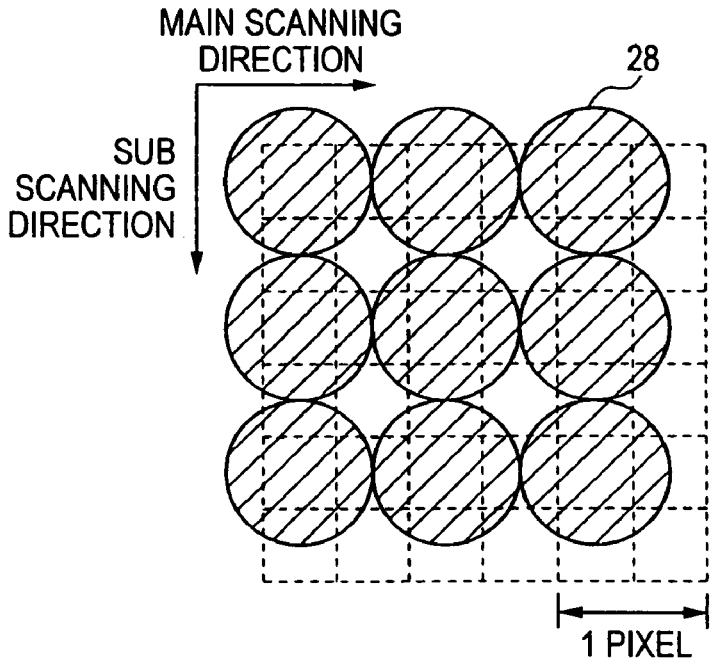
FIGS. 8A and 8B are views showing a lighting control of the LED head in one embodiment.
Figure 8B:
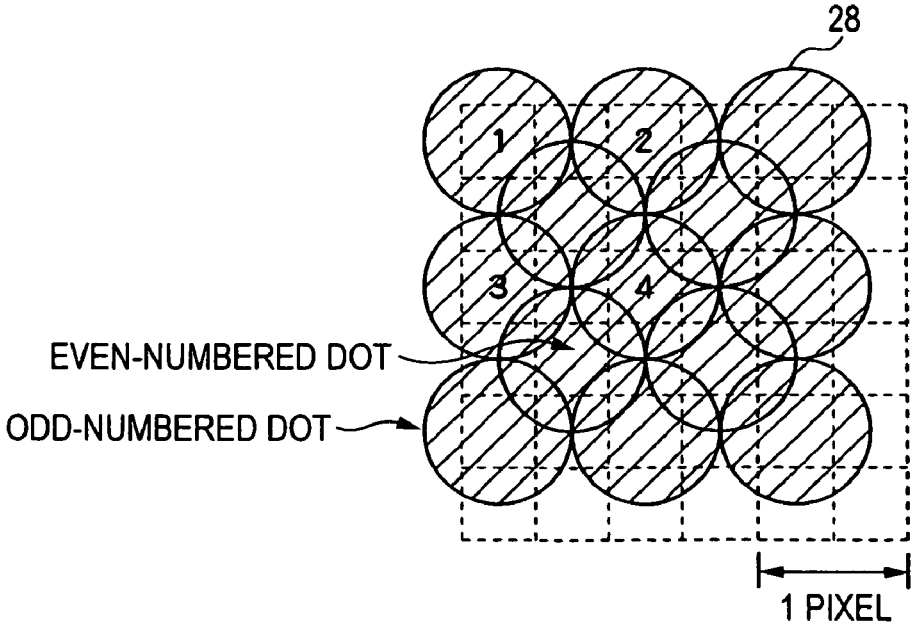

FIGS. 8A and 8B illustrate the lighting control of the LED head 18 in the present embodiment. Also the present embodiment adopts the above-described relationship a=2b, and utilizes the odd-numbered dots 28 as the main dots for exposing the photosensitive drum 20, but the even-numbered dots 28 are also used as auxiliary dots when necessary. In FIGS. 8A and 8B, four squares defined by broken lines constitute a pixel.

In FIG. 8A, each dot 28 provided in the LED head 18 of the present embodiment has a size of ½ in comparison with that in the prior configuration, so that the toner images tend to show spaces therebetween in case an odd-numbered dot 28 is assigned for each pixel.

Therefore, as shown in FIG. 8B, the image data to be outputted are decomposed, around a target pixel, into a matrix of 2 pixels in the main scanning direction by 2 pixels in the sub scanning direction, and, in case all the odd-numbered dots 28 of Nos. 1-4 are turned on, an even-numbered dot 28 surrounded by such dots is also turned on in auxiliary manner. It is thus possible to recognize whether the image is a solid image and to achieve a strong exposure so as to avoid a density unevenness in the solid image.

At the image data printing, a pattern of the dots 28 turned on in the matrix is detected by the pattern recognition part 14. The matrix is not limited to a size of 2×2 but can be of c×d (c and d being arbitrary natural numbers).

The lighting control for the main dots and the auxiliary dots is executed by the lighting control part 12. The lighting control part 12 can achieve a control for turning on the desired auxiliary dots, not only in the pattern shown in FIGS. 8A and 8B but also according to an arbitrary turn-on pattern of the main dots in a desired matrix. Thus an appropriate exposure on the photosensitive drum can be achieved according to the image data.

Also the present embodiment, executing the lighting control of the auxiliary dot not according to the user instruction but by the result of detection by the pattern recognition part 14, can realize a stable control regardless of the experience of the user.

Figure 9:
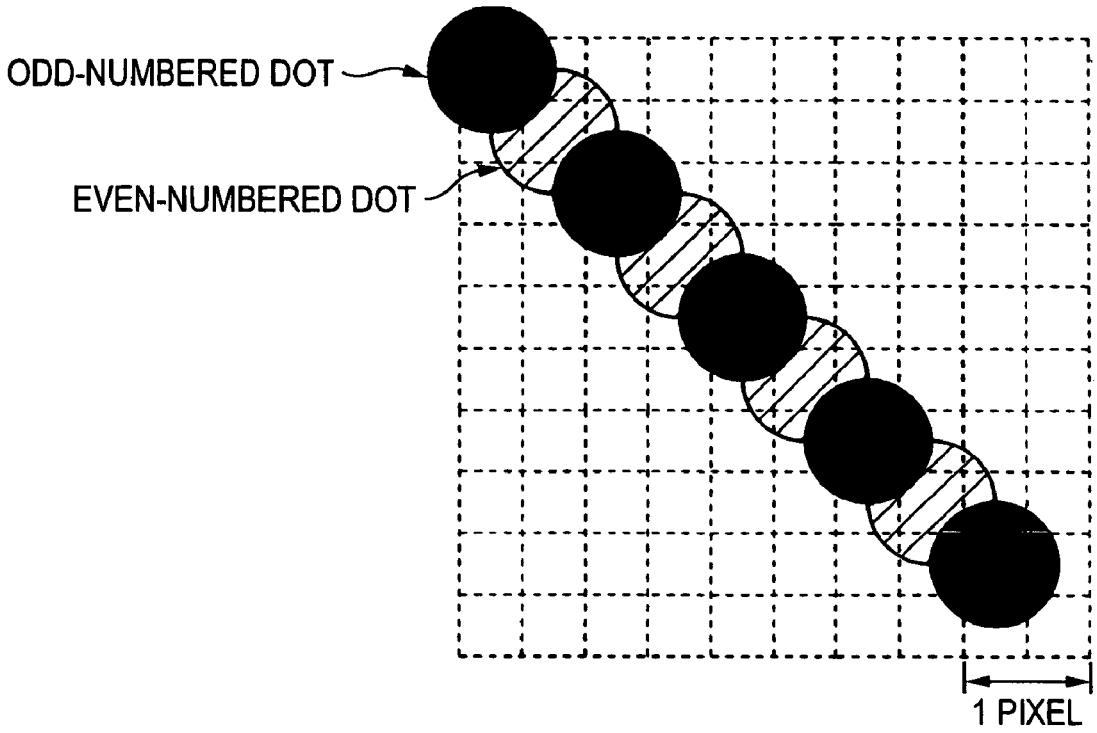
FIG. 9 is a view showing a case of applying the lighting control of the LED head in one embodiment to a smoothing.

FIG. 9 illustrates an application of the lighting control of the LED head 18 of the present embodiment to a smoothing. The smoothing means a technology, for example in a diagonal line image output, of weakly turning on peripheral pixels of the diagonal line, in order to eliminate a jagged contour which is a weak point of digital image output.

In case the pattern recognition part 14 identifies, as shown in FIG. 9, a diagonally arranged turn-on pattern (in main dots represented by black circles) in the 2×2 pixel matrix, the lighting control part 12 turns on a hatched auxiliary dot. In this situation, the auxiliary dot is turned on at a timing displaced by ½ line from that for the main dot, and with a pulse width of ½ of the normal state. Thus a smoothing of a higher quality than in the prior technology can be realized.

The smoothing may be executed by determining the auxiliary dots not only for a 2×2 pixel matrix but also for a larger pixel matrix. Also the auxiliary dot may be of an exposure amount different from that for the main dot.

EMBODIMENT 5

In the present embodiment, the operation part 36 of the image forming apparatus shown in FIG. 1 is provided with a toner save mode button. In such toner save mode which gives priority to a cost reduction in comparison with the image quality and suppresses the toner consumption as far as possible, the lighting control part 12 executes a control of forcibly inhibiting a turning-on of the auxiliary dot or an increase in the exposure amount per dot.

EMBODIMENT 6

The present embodiment also adopts the above-described relationship a=2b, and the lighting control part 12 executes a control of interchanging the main dot in the LED array 32 and the auxiliary dot adjacent thereto at a predetermined timing.

More specifically, the lighting control part 12, upon receiving a first output instruction from the operation control part 10, exposes the photosensitive drum 20 utilizing the odd-numbered dots 28 only. Then, upon receiving a next output instruction, it exposes the photosensitive drum 20 utilizing the even-numbered dots 28 only. Also upon receiving a further next input instruction, it exposes the photosensitive drum 20 utilizing the odd-numbered dots 28 only. In this manner the dots 28 serving as the main dots are switched at a predetermined timing.

A light emission amount of a light-emitting diode generally decreases as a function of turn-on time, but the above-described structure switches the turn-on dots 28 at a predetermined timing and can delay the deterioration of each dot 28 thereby extending the service life of the LED head 18.

EMBODIMENT 7

The present embodiment also adopts the above-described relationship a=2b, and the lighting control part 12 executes a control of interchanging the main dot in the LED array 32 and the auxiliary dot adjacent thereto according to a type of the image data.

The operation part 36 is provided, in a panel thereof, with a button for selecting a type of the original. In case the user selects "character/line image" as the type of the original, the photosensitive drum 20 is exposed with the odd-numbered dots 28 only. Also in case the user selects "photograph" as the type of the original, the photosensitive drum 20 is exposed with the even-numbered dots 28 only.

In outputting a photographic image, a streaking unevenness becomes conspicuous in a halftone area when the dots 28 have unevenness in the light emitting amount. On the other hand, in outputting a character/line image, the unevenness in density is not noticeable and the dots 28 having unevenness in the light emitting amount may be employed without difficulty.

A character/line image often includes a vertical line in a frame position of a drawing original or in a position determined by a document format, and only a dot 28 corresponding to such position has a longer turn-on time and shows more deterioration in the light emission amount. On the other hand, in a photographic image, all the dots 28 are turned on generally uniformly and the deterioration in the light emission amount does not take place in a part of the dots 28. Therefore, the present embodiment, by switching the dots 28 to be used for outputting a character/line image and those to be used for outputting a photographic image, can prevent a streaked density unevenness in the photographic image.

EMBODIMENT 8

Also the present embodiment adopts the above-described relationship a=2b. Also, as shown in FIG. 2, the LED head 18 is equipped with a memory 34 storing correction data for correcting the light emission amounts of the dots 28. The lighting control part 12 corrects a brightness or a turn-on pulse width according to the correction data. The correction data for the dots 28 are generally determined according to unevenness in the lights amounts, in the dot areas, in the dot pitch and in the condenser lenses 30.

The present embodiment executes a lighting control utilizing different correction data, for a case of turning on the odd-numbered dots 28 only, a case of turning on the even-numbered dots 28 only, and a case of turning on all the dots 28. Thus an optimum control can be realized according to the dots 28 to be turned on. More specifically, the dots 28 involve unevenness generated for example at the manufacture, so that the correction data appropriate for a case of turning on every other dot such as the odd-numbered dots 28 only or the even-numbered dots 28 only are different from the correction data appropriate for a case of turning on all the dots 28. Therefore, the lighting control utilizing the respectively appropriate correction data as in the present embodiment allows providing a satisfactory image quality with reduced streak unevenness.

The entire disclosure of Japanese Patent Application No. 2005-271108 filed on Sep. 16, 2005 including specification, claims, drawings and abstract is incorporated herein by reference in its entirety.

What is claimed is:

1. An image forming apparatus utilizing a light-emitting diode (LED), comprising:

an LED head including an LED array that has a plurality of dots, in which a resolution a (dpi) of the LED array and a resolution b (dpi) in a main scanning direction at an image data exposure satisfy a relation:

a>b (a being an integral multiple of b);

a lighting control unit that performs a lighting control for the LED head such that main dots used for an exposure are turned on in every {(a/b)−1} dots; and a pattern recognition unit that performs a pattern recognition with respect to a pattern in a matrix of c×d pixels (c and d being arbitrary natural numbers) around a target pixel in the image data;

wherein the lighting control unit controls the lighting of the main dots and the lighting of auxiliary dots based on the pattern recognition.

2. The image forming apparatus as claimed in claim 1, wherein the lighting control unit alternatively operates a mode of turning on only a main dot for a pixel or a mode of turning on both a main dot and an auxiliary dot adjacent thereto for a pixel in accordance with a type of image data.

3. The image forming apparatus as claimed in claim 2, wherein the lighting control unit turns on both the main dots and the auxiliary dots such that an average exposure amount of the main dots is different from an average exposure amount of auxiliary dots.

4. The image forming apparatus as claimed in claim 1, wherein the lighting control unit controls an average exposure amount of the main dots according to a type of the image data.

5. The image forming apparatus as claimed in claim 1, wherein the lighting control unit performs a mode of forcibly inhibiting a turning-on of auxiliary dots.

6. The image forming apparatus as claimed in claim 1, wherein the lighting control unit performs a mode of forcibly inhibiting an increase in the exposure amount per dot.

7. The image forming apparatus as claimed in claim 1, wherein the lighting control unit interchanges a main dot in the LED array and an auxiliary dot adjacent to the main dot at a predetermined timing.

8. The image forming apparatus as claimed in claim 1, wherein the lighting control unit interchanges a main dot in the LED array and an auxiliary dot adjacent to the main dot according to a type of the image data.

9. The image forming apparatus as claimed in claim 1, wherein the lighting control unit stores correction data for correcting a light emission amount of each dot; and the correction data includes a first correction data used for turning on only the main dots of the LED array and a second correction data used for turning on both the main dots and the auxiliary dots adjacent thereto.

* * * * *